US008757628B1

(12) United States Patent
Baker

(10) Patent No.: US 8,757,628 B1
(45) Date of Patent: Jun. 24, 2014

(54) BALL CAPTURE GAME ASSEMBLY

(76) Inventor: Rick Baker, Olympia, WA (US)

( * ) Notice: Subject to any disclaimer, the term of this patent is extended or adjusted under 35 U.S.C. 154(b) by 416 days.

(21) Appl. No.: 13/314,634

(22) Filed: Dec. 8, 2011

(51) Int. Cl.
*A63F 9/34* (2006.01)

(52) U.S. Cl.
USPC ..... 273/448; 273/118 R; 273/118 A; 273/456

(58) Field of Classification Search
USPC ..... 273/118 R, 118 A, 119 R, 119 A, 440, 273/445, 447, 456, 459
See application file for complete search history.

(56) References Cited

U.S. PATENT DOCUMENTS

| | | | | |
|---|---|---|---|---|
| 553,693 | A | 1/1896 | Smith | |
| 606,744 | A | 7/1898 | St. John | |
| 2,218,825 | A | 10/1940 | Le Guillou | |
| 2,904,336 | A | 9/1959 | Washburn | |
| 3,223,419 | A | 12/1965 | Isaacs et al. | |
| 3,578,319 | A * | 5/1971 | Kohner et al. | 273/445 |
| 3,643,954 | A * | 2/1972 | Meyer et al. | 273/119 A |
| 3,781,015 | A | 12/1973 | Ellman et al. | |
| 3,836,142 | A | 9/1974 | Baker | |
| 4,061,334 | A * | 12/1977 | Kanno | 273/126 A |
| 4,961,580 | A * | 10/1990 | Yoe et al. | 273/447 |
| 5,342,064 | A * | 8/1994 | Williamson et al. | 273/447 |
| 5,368,300 | A * | 11/1994 | Becker | 273/121 R |
| 5,427,529 | A * | 6/1995 | Dunse | 434/167 |
| 6,412,782 | B1 * | 7/2002 | Rivet et al. | 273/457 |
| 6,789,798 | B1 | 9/2004 | Adams et al. | |
| 7,798,494 | B1 * | 9/2010 | Benjamin | 273/119 R |
| 2001/0050461 | A1 | 12/2001 | Tarbell | |

* cited by examiner

*Primary Examiner* — Raleigh W Chiu

(57) ABSTRACT

A ball capture game assembly provides a structure having spaced access channels through which balls are removed to score points. The assembly includes a housing having a bottom, a top, and a perimeter wall defining an interior space. At least one channel is coupled to the housing. Each channel has an inner opening in fluid communication with the interior space and an outer opening configured for fluid communication with ambient space outside the housing. A plurality of balls is positioned in the interior space of the housing. A tip of an elongated member is selectively couplable to each of the balls whereby each ball is removable from the interior space by insertion and withdrawal of the elongated member through the channel.

15 Claims, 5 Drawing Sheets

BALL CAPTURE GAME ASSEMBLY

BACKGROUND OF THE DISCLOSURE

Field of the Disclosure

The disclosure relates to game devices and more particularly pertains to a new game device for providing a structure having spaced access channels through which balls are removed to score points in the game.

SUMMARY OF THE DISCLOSURE

An embodiment of the disclosure meets the needs presented above by generally comprising a housing having a bottom, a top, and a perimeter wall defining an interior space. At least one channel is coupled to the housing. Each channel has an inner opening in fluid communication with the interior space and an outer opening configured for fluid communication with ambient space outside the housing. A plurality of balls is positioned in the interior space of the housing. A tip of an elongated member is selectively couplable to each of the balls whereby each ball is removable from the interior space by insertion and withdrawal of the elongated member through the channel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
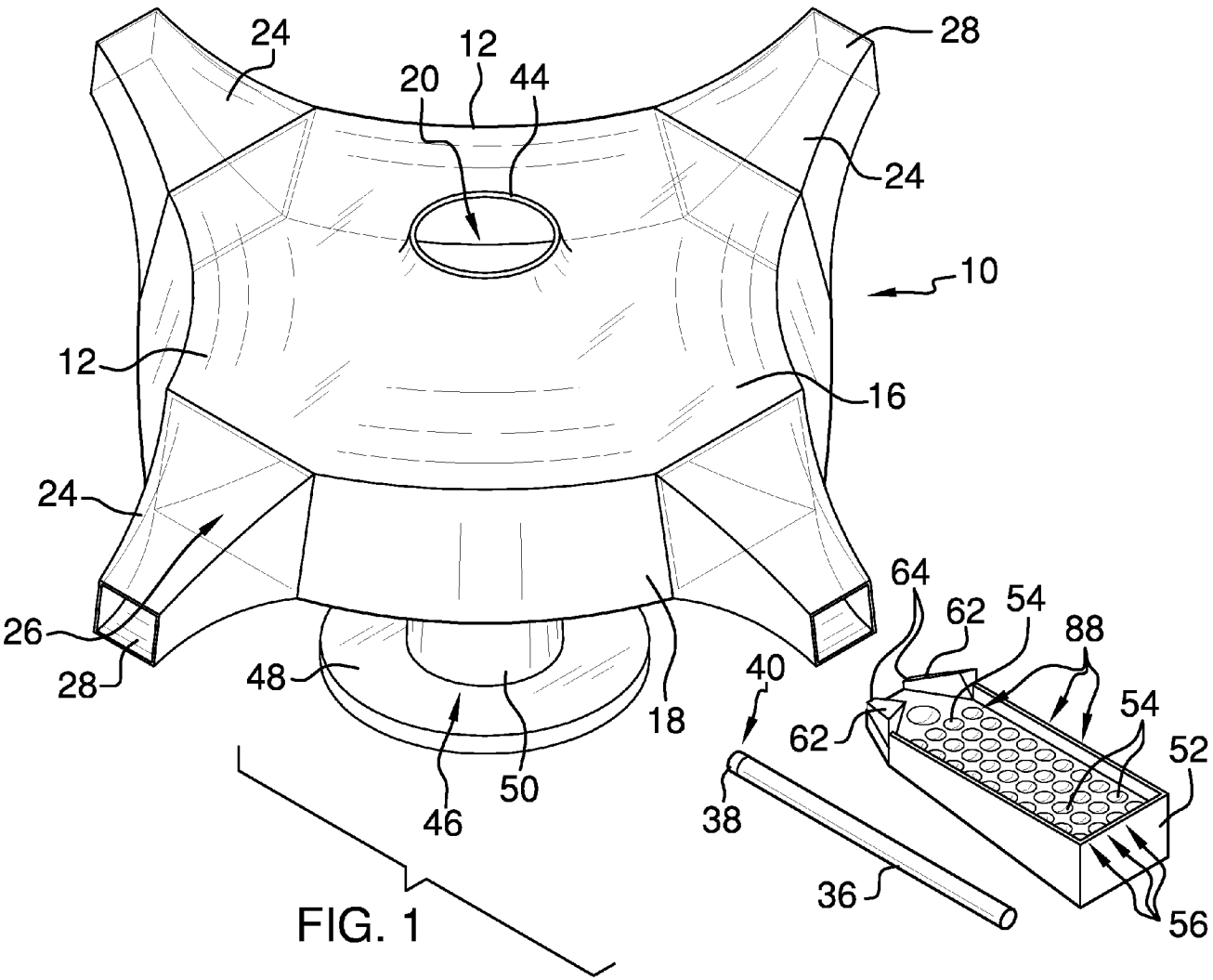
FIG. 1 is a top front side perspective view of a ball capture game assembly according to an embodiment of the disclosure.
Figure 2:
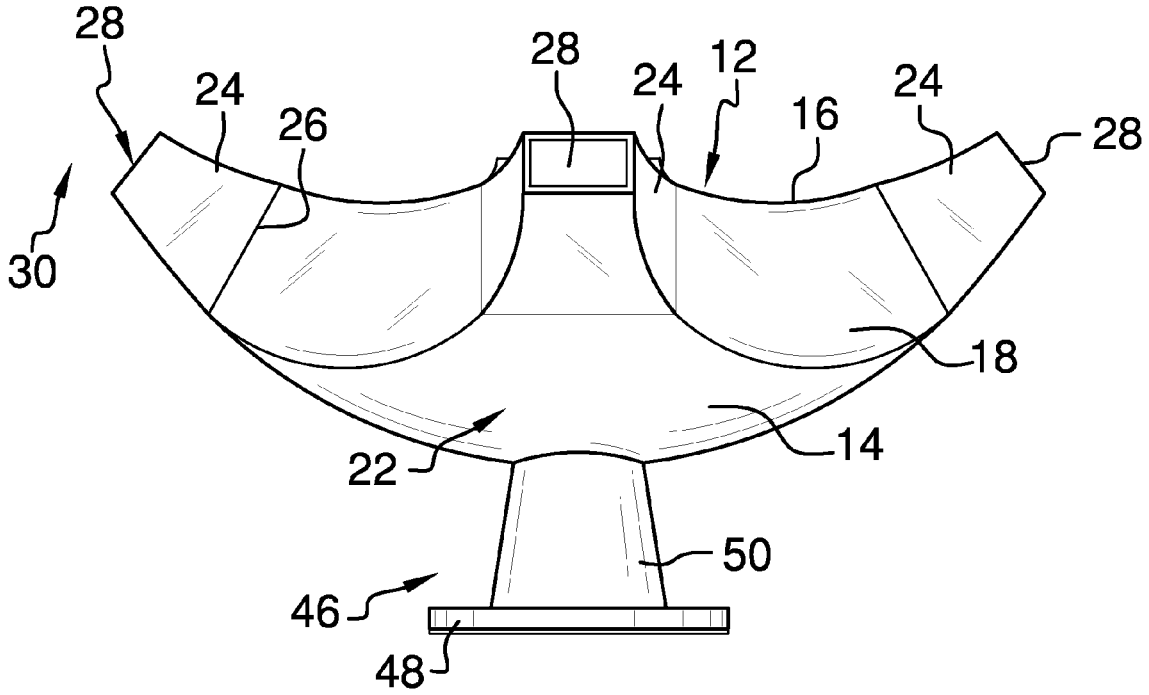
FIG. 2 is a front view of an embodiment of the disclosure.
Figure 3:
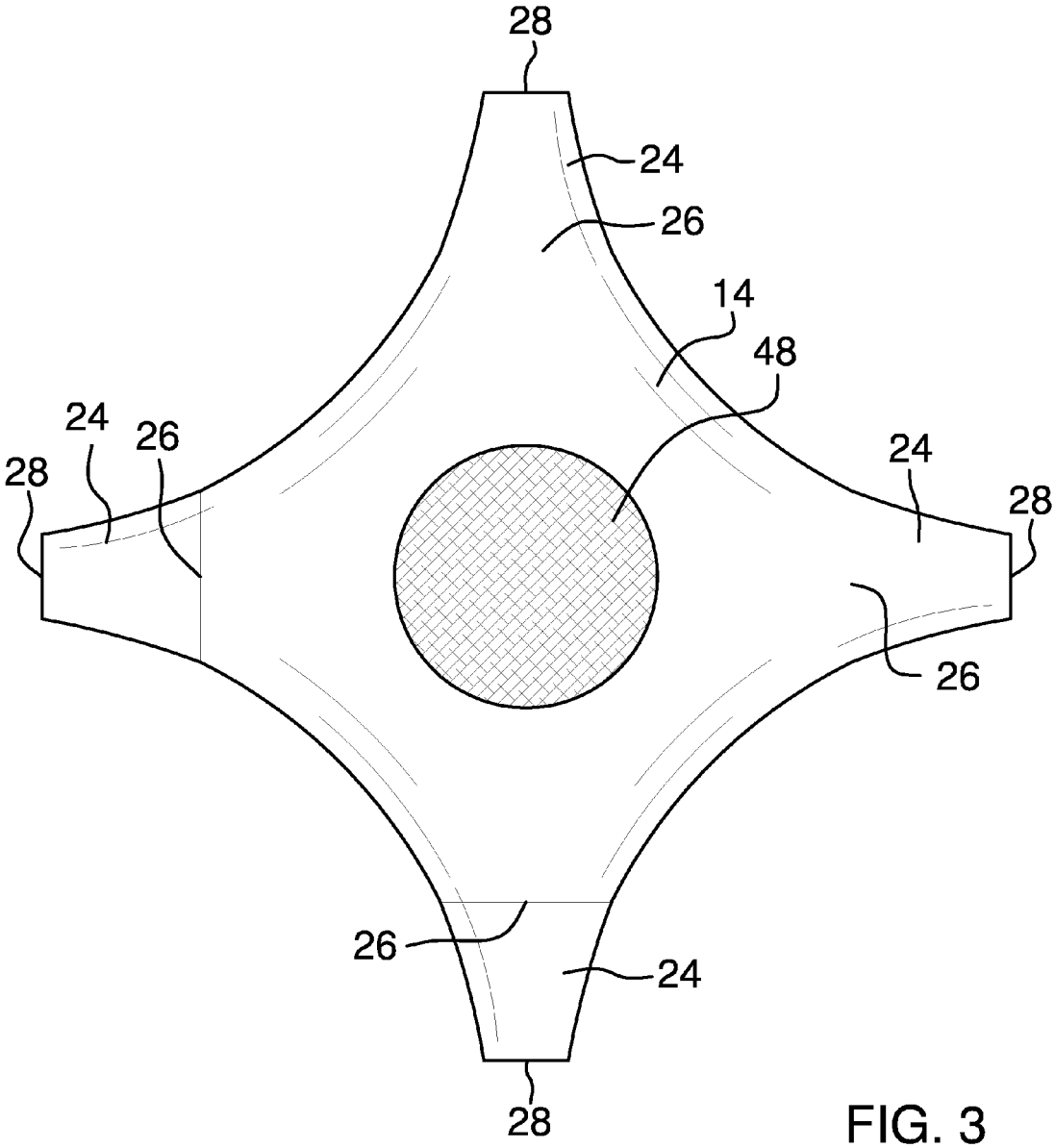
FIG. 3 is a bottom view of an embodiment of the disclosure.
Figure 4:
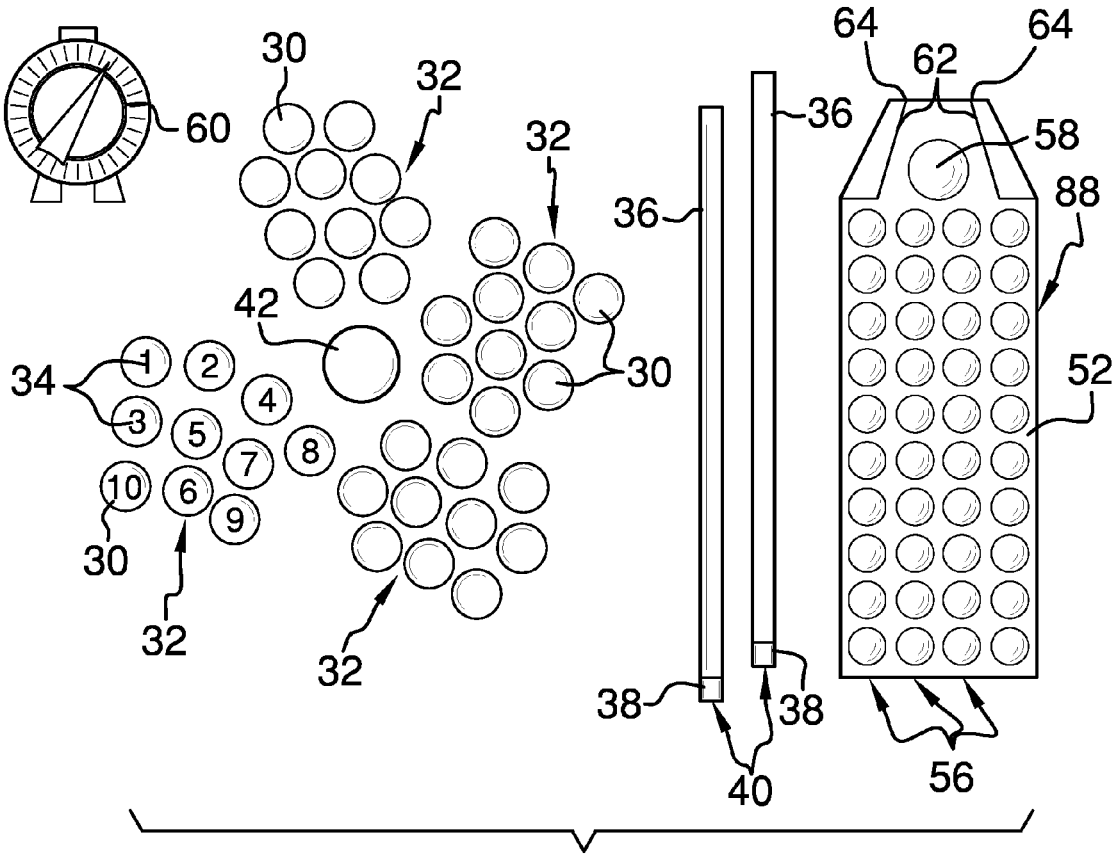
FIG. 4 is a top view of an embodiment of the disclosure.
Figure 5:
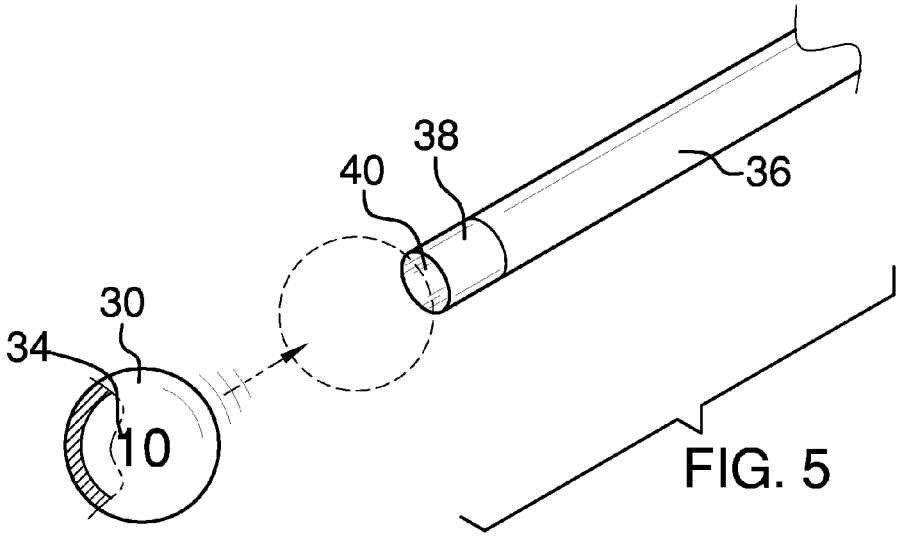
FIG. 5 is a top front side partially exploded detailed view of an embodiment of the disclosure.
Figure 6:
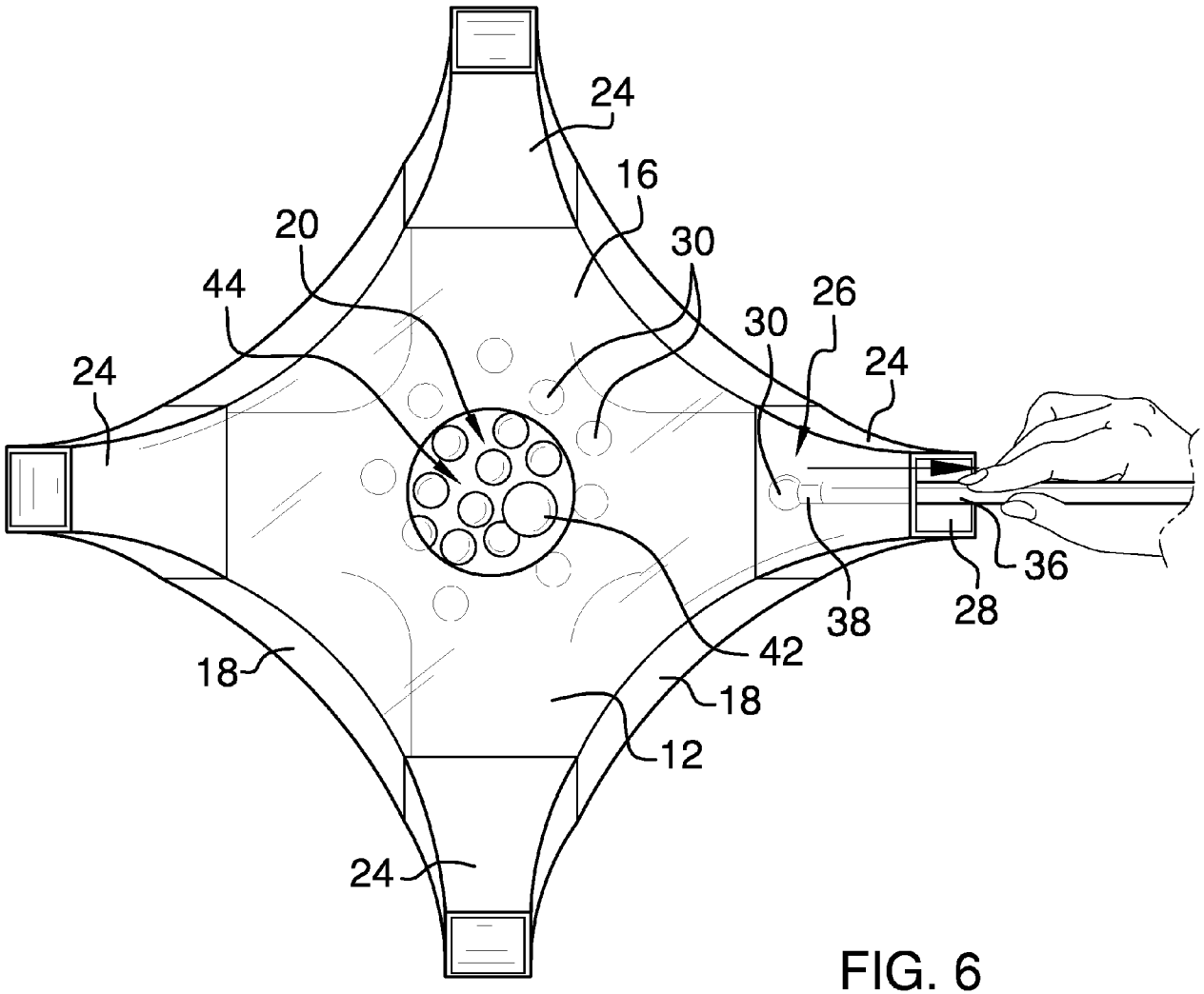
FIG. 6 is a top view of an embodiment of the disclosure in use.

With reference now to the drawings, and in particular to FIGS. 1 through 6 thereof, a new game device embodying the principles and concepts of an embodiment of the disclosure and generally designated by the reference numeral 10 will be described.

As best illustrated in FIGS. 1 through 6, the ball capture game assembly 10 generally comprises a transparent housing 12 having a bottom 14, a top 16, and a perimeter wall 18 defining an interior space 20. The bottom 14 of the housing 12 may be curved such that a central portion 22 of the bottom curves upwardly extending towards said perimeter wall 18. A plurality of channels 24 is coupled to the housing 12. Each channel 24 has an inner opening 26 in fluid communication with the interior space 20. Each channel 24 also has an outer opening 28 configured for fluid communication with ambient space 30 outside the housing 12. Each channel 24 may curve upwardly extending from the interior opening 26 towards the exterior opening 28. Each channel 24 may also taper extending from the interior opening 26 towards the exterior opening 28.

A plurality of magnetic balls 30 are positioned in the interior space 20 of the housing 12. The balls 30 have a uniform circumferential size and may be constructed of steel. Each of the balls is a single color selected from a preselected set of colors red, blue, green and yellow. Thus the balls 30 are divisible into four separate sets of similarly colored balls 32. Each of the similarly colored balls 32 having indicia 34 thereon. The indicia 34 on the similarly colored balls 32 forms a numerical sequence from numeral one to numeral ten.

At least one elongated member 36 is provided. A tip 38 of the member 36 is a magnet 40 selectively couplable to each of the balls 30 whereby each ball 30 is removable from the interior space 20 by insertion and withdrawal of the elongated member 36 through each channel 24.

A marble 42 is also positioned in the interior space 20. The marble 42 is also magnetic and may be golden in color. The degree of attraction between the tip 38, the balls 30 and the marble 42 is such that they may be disengaged as the ball 30 or marble 42 is manipulated through the channel 24. The marble 42 may have a greater weight and has a greater circumferential size than each ball 30. Thus, the marble 42 requires greater dexterity and skill to remove from the interior space 20 through one of the channels 24.

An access opening 44 is positioned in the top 16 of the housing 12 to facilitate placing the balls 30 and the marble 42 back into the interior space 20 of the housing 12. A stand 46 may be coupled to the housing 12 to elevate the housing 12. The stand 46 has a planar base 48 and a post 50 extending between the base 46 and the bottom 14 of the housing 12.

A plurality of trays 52 is provided. Each tray 52 has a plurality of indentations 54 arranged into ten rows 88 by four columns 56. Each indentation 54 is shaped to receive one of the balls 30 whereby the ball 30 is held in a static position in the indentation 54. The tray also has a dimple 58 shaped for receiving the marble 42 whereby the marble 42 is held in a static position on the tray 52. Each tray 52 may have angled walls 62 tapering together to spaced edges 64 positionable adjacent to the access opening 44 to facilitate putting the marble 42 and the balls 30 back into the housing 12 after a turn is ended.

A timer 60 may also be provided to time each turn taken by a player or to alternately set an overall time limit for the length of the game.

In use, players would take a pre-determined number of turns using the elongated member 36 to remove the balls 30 from the housing 12 by coupling the tip 38 to each ball 30 and sliding the coupled ball 30 out of one of the channels 24. Successfully removing each ball awards the player a number of points corresponding to the numerical indicia on the ball 30 removed. If all the similarly colored balls 32 are removed during a single turn, the point score for those similarly colored balls 32 is doubled. The larger marble 42 may also be removed for a point score of 25. Each turn is timed using the timer 60. The structure of the housing 12 and channels 24 provides for additional variations in the rules of the game to provide variable degrees of challenge. Variations may include restrictions on which color may be withdrawn through each channel 24, a sequence by which colors must be withdrawn from the housing 12, restrictions on which channel 24 each player may use to withdraw the balls 30, or other variations as may be desired by the players.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A game assembly comprising:

a housing having a bottom, a top, and a perimeter wall defining an interior space;

a channel coupled to said housing, said channel having an inner opening in fluid communication with said interior space, said channel having an outer opening configured for fluid communication with ambient space outside said housing;

a plurality of balls positioned in said interior space of said housing;

an elongated member, a tip of said member being selectively couplable to each of said balls whereby each said ball is removable from said interior space by insertion and withdrawal of said elongated member through said channel.

2. The assembly of claim 1, further including said balls having a uniform circumferential size.

3. The assembly of claim 1, further comprising:

each said ball being constructed of a magnetic material; and said tip of said elongated member being a magnet.

4. The assembly of claim 2, further including a marble positioned in said interior space, said marble having a greater circumferential size than each said ball.

5. The assembly of claim 1, further including an access opening in said top of said housing.

6. The assembly of claim 1, further including said bottom of said housing being curved.

7. The assembly of claim 6, further including a stand coupled to said housing, said stand having a planar base and a post portion extending between said base and said bottom of said housing.

8. The assembly of claim 2, further including each of said balls being a single color selected from a preselected set of colors whereby said balls are divisible into separate sets of similarly colored balls.

9. The assembly of claim 8, further including each of said similarly colored balls having indicia thereon.

10. The assembly of claim 9, further including said indicia on said similarly colored balls forming a numerical sequence.

11. The assembly of claim 4, further including a plurality of trays, each tray having a plurality of indentations, each indentation being shaped to receive one of said balls whereby said ball is held in a static position in said indentation.

12. The assembly of claim 11, further including said tray having a dimple, said dimple being shaped for receiving said marble whereby said marble is held in a static position.

13. The assembly of claim 4, further including a timer.

14. The assembly of claim 1, further including said housing being transparent.

15. A game assembly comprising:

a housing having a bottom, a top, and a perimeter wall defining an interior space, said bottom of said housing being curved;

a channel coupled to said housing, said channel having an inner opening in fluid communication with said interior space, said channel having an outer opening configured for fluid communication with ambient space outside said housing;

a plurality of balls positioned in said interior space of said housing, said balls having a uniform circumferential size, each said ball being constructed of a magnetic material, each of said balls being a single color selected from a preselected set of colors whereby said balls are divisible into separate sets of similarly colored balls, each of said similarly colored balls having indicia thereon, said indicia on said similarly colored balls forming a numerical sequence;

an elongated member, a tip of said member being selectively couplable to each of said balls whereby each said ball is removable from said interior space by insertion and withdrawal of said elongated member through said channel, said tip of said elongated member being a magnet;

a marble positioned in said interior space, said marble being constructed of a magnetic material, said marble having a greater circumferential size than each said ball;

an access opening in said top of said housing;

a stand coupled to said housing, said stand having a planar base and a post portion extending between said base and said bottom of said housing;

a plurality of trays, each tray having a plurality of indentations, each indentation being shaped to receive one of said balls whereby said ball is held in a static position in said indentation, said tray having a dimple, said dimple being shaped for receiving said marble whereby said marble is held in a static position; and a timer.

* * * * *